US007063314B2

(12) United States Patent
Eskey

(10) Patent No.: US 7,063,314 B2
(45) Date of Patent: Jun. 20, 2006

(54) MEDIA HANDLING DEVICE AND METHODS

(75) Inventor: Eric U. Eskey, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 77 days.

(21) Appl. No.: 10/298,752

(22) Filed: Nov. 18, 2002

(65) Prior Publication Data

US 2004/0094886 A1 May 20, 2004

(51) Int. Cl.
*B65H 3/44* (2006.01)

(52) U.S. Cl. ..... 271/9.01; 271/9.11; 271/9.12

(58) Field of Classification Search ..... 271/9.01, 271/9.05, 9.07, 9.11, 9.12, 9.13
See application file for complete search history.

(56) References Cited

U.S. PATENT DOCUMENTS

| | | | | |
|---|---|---|---|---|
| 2,755,090 A | * | 7/1956 | Aldrich | 273/149 R |
| 4,053,152 A | * | 10/1977 | Matsumoto | 271/9.07 |
| 4,303,235 A | * | 12/1981 | Calabrese | 271/162 |
| 4,674,734 A | * | 6/1987 | Ibuchi | 271/9.11 |
| 5,085,421 A | | 2/1992 | Sellers | |
| 5,100,122 A | | 3/1992 | Noda et al. | |
| 5,102,112 A | | 4/1992 | Takahashi | |
| 6,135,438 A | * | 10/2000 | Newman et al. | 271/9.07 |
| 6,217,018 B1 | | 4/2001 | Tay et al. | |
| 6,241,237 B1 | | 6/2001 | Bokelman | |
| 6,390,703 B1 | | 5/2002 | Kinas et al. | |
| 2002/0050680 A1 | | 5/2002 | Yanagi et al. | |

FOREIGN PATENT DOCUMENTS

| | | | |
|---|---|---|---|
| DE | 3234562 A1 | | 9/1982 |
| DE | 3445633 A1 | | 12/1984 |
| DE | 3741311 A1 | | 12/1987 |
| EP | 0974540 A2 | | 1/2000 |
| JP | 4-365730 A | * | 12/1992 |
| JP | 5-286581 A | * | 11/1993 |

OTHER PUBLICATIONS

U.S. Appl. No. 10/147,251 filed May 15, 2000, for "Imaging Apparatus And Methods" of Eric Eskey.

* cited by examiner

*Primary Examiner*—David H. Bollinger

(57) ABSTRACT

Disclosed herein is a media handling device for handling sheets of media contained in a conglomerate stack.

21 Claims, 7 Drawing Sheets

MEDIA HANDLING DEVICE AND METHODS

BACKGROUND

Media handling devices are utilized for processing sheets of media into documents. Media handling devices perform at least one task such as printing, scanning, binding, and sorting. Media handling devices can also be configured to perform more than one function, such as a four-in-one device that is used for printing, scanning, copying and faxing.

In general, one type of media handling device is used to form an image on a sheet of media. When used for forming images, media handling devices are sometimes referred to as imaging apparatus, facsimile machines, copiers or printers. These sheets of media may, for example, be paper sheets, transparent plastic sheets, envelopes, cardstock, or labels. These types of media vary in properties such as size, thickness, texture and color. Media handling devices are configured to accept these varying types and sizes of media.

A media handling device may be provided with an input tray and a stack. The stack typically contains one type and size of media that is usually located within the input tray. The media handling device, such as a printer that prints a document, processes sheets of media contained in the stack.

One type of conventional media handling device (such as a printer used in a home office) is provided with a first input tray, a second input tray and one pick mechanism. The first input tray contains a stack of a first type of media. The second input tray manually receives one sheet at a time of a second type of media. The pick mechanism feeds one sheet at a time from either input tray into the media handling device. When printing a two-page document on two types of media, the user must manually input the second type of media into the second input tray. For example, when printing a letter and an envelope, the media handling device obtains letterhead from the stack located in the first input tray and the envelope from the second input tray. The process of manually placing the envelope into the second input tray requires time and complicates the printing process.

Another type of conventional media handling device is provided with a first input tray, a second input tray, a first pick mechanism and a second pick mechanism. The first input tray contains a first stack of a first type of media; sheets are removed from this first stack by the first pick mechanism. The second input tray contains a different second stack of a second type of media; sheets are removed from this second stack by the second pick mechanism. When printing a letter and an envelope, this second type of media handling device obtains letterhead from the first input tray and the envelope from the second input tray. Because there are two separate pick mechanism and two separate trays, this media handling device can be relatively large and has a complicated mechanical system.

SUMMARY

In one exemplary embodiment, a media handling device may include: a conglomerate stack that may include a first stack and a second stack; and a pick mechanism configured to selectively pick sheets from the conglomerate stack.

BRIEF DESCRIPTION OF THE DRAWING

Illustrative embodiments are shown in Figures of the drawing in which.

DETAILED DESCRIPTION

Introduction

Figure 1:
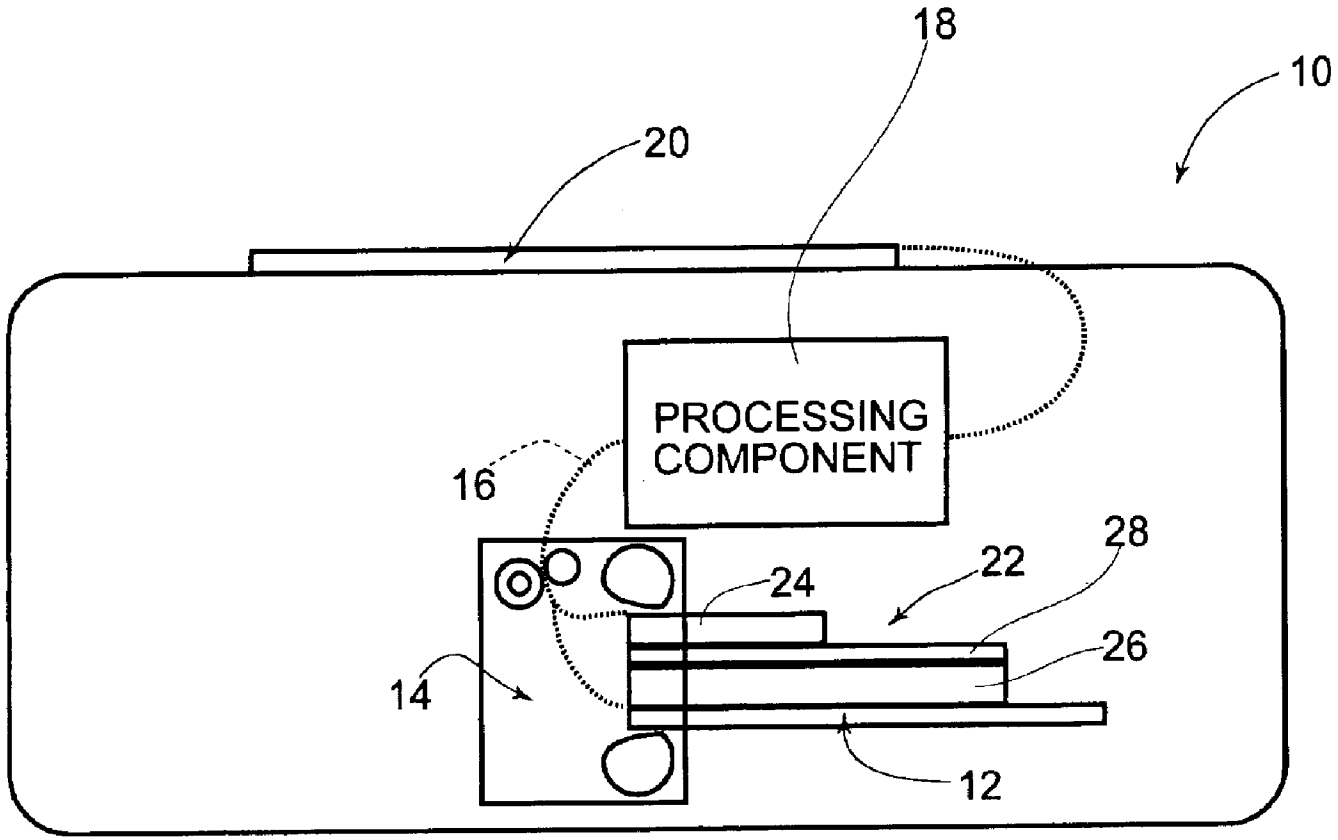
FIG. 1 shows a schematic side elevation diagram of a media handling device provided with a processing component.

In a simplified embodiment illustrated in FIG. 1, a media handling device 10 may include an input tray 12, a pick mechanism 14, a path 16, a processing component 18 and an output area 20. The pick mechanism 14 may be substantially located between the input tray 12 and the path 16. The path 16 is connected to the processing component 18 and the output area 20. The input tray 12 contains a conglomerate stack 22. This conglomerate stack 22 may be provided with a first stack 24, a second stack 26 and a divider 28. The stacks 24, 26 may be separated by the divider 28. The first stack 24 contains a first type of media, such as letterhead. The second stack 26 contains a second type of media, such as transparent plastic sheets. In a process detailed later herein, the pick mechanism 14 can selectively pick a sheet (referred to as a picked sheet) from either type of media contained in the conglomerate stack 22. This picked sheet is then introduced into and travels along the path 16 towards the output area 20. The picked sheet is processed by the processing component 18 as it travels along the path 16. After being processed, the picked sheet is moved along the path 16 to the output area 20. The media handling device 10 can be directed to pick either type of media contained within the conglomerate stack 22 with one pick mechanism 14; this picking occurs without the need to manually change either stack 24, 26 contained in the conglomerate stack 22. Accordingly, different types of media can be stored for future use in a single input tray 12.

Having provided a general description of the processing of media with the media handling device 10 illustrated in FIG. 1, a more detailed description will be provided.

Embodied in a Printer

Figure 2:
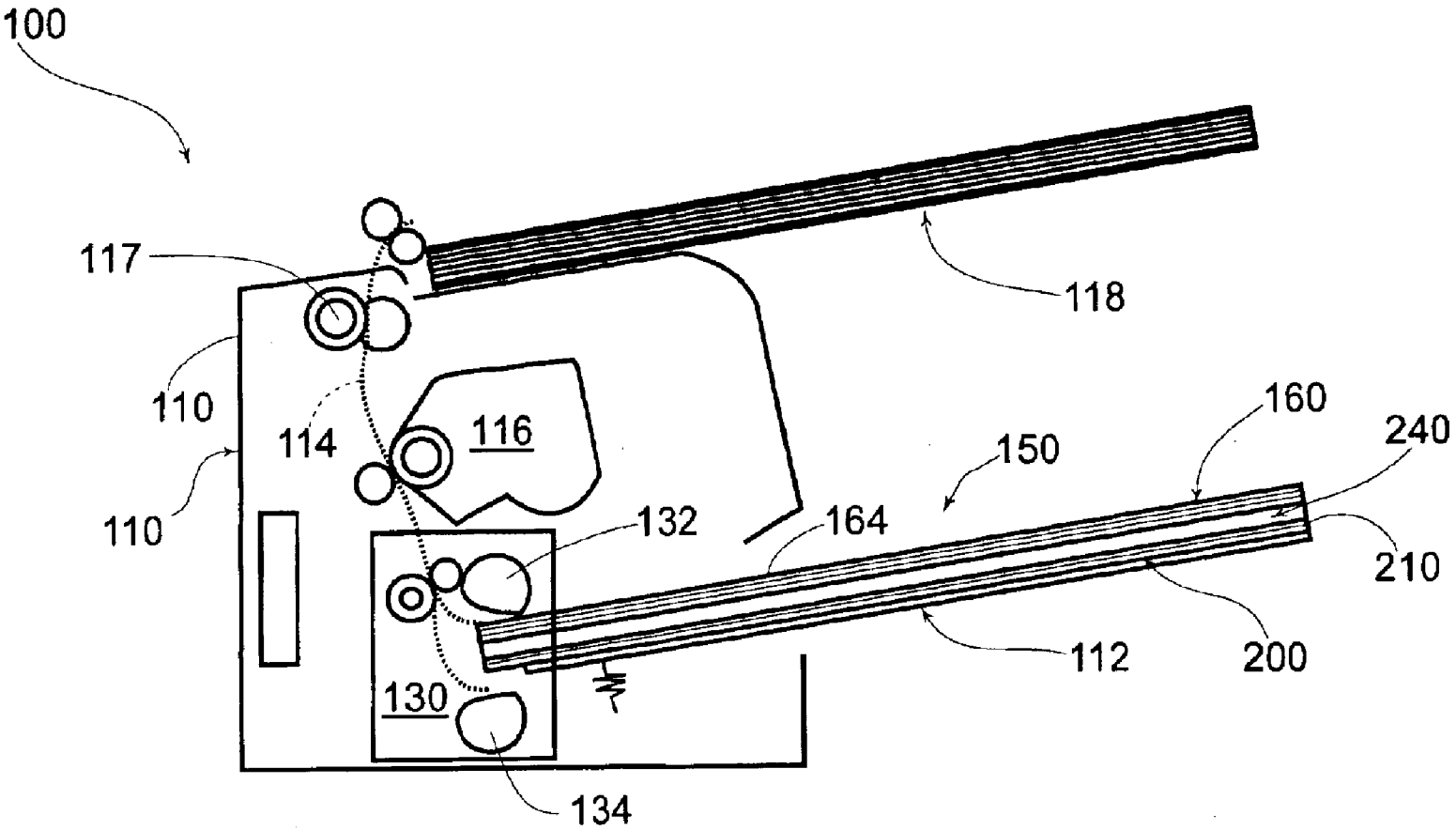
FIG. 2 shows a schematic side elevation diagram of one type of media handling device referred to as a printer.

As schematically illustrated in FIG. 2, one type of media handling device referred to as a printer 100 is provided with a housing 110. The printer housing 110 may contain various conventional elements that allow for images to be formed on sheets of media. The printer 100 is also provided with an input tray 112, a path 114, an imaging device 116, a fuser 117, an output area 118 and a pick mechanism 130. The pick mechanism 130 is located between the input tray 112 and the path 114. The path 114 is connected to the imaging device 116, the fuser 117 and the output area 118.

FIG. 2 also illustrates that the pick mechanism 130 is provided with a picker, such as a first pick roller 132 and a second pick roller 134. It should be noted that the pick mechanism picker can, for example, be any conventional device capable of removing sheets from two points of a conglomerate stack, such as friction belts, rollers, D-rollers, and the like. The exemplary pick mechanism 130 may be substantially similar to those well known in the art, except that the present pick mechanism 130 has two pick rollers 132, 134 (instead of the conventional single pick roller configuration). Pick mechanisms well know in the art include those described in U.S. Pat. No. 6,241,237 issued on Jun. 5, 2001 of Bokelman for an AUTOMATIC DOCUMENT FEEDING METHOD AND APPARATUS AND DUPLEXING DOCUMENT SCANNING DEVICE USING THE SAME, U.S. Pat. No. 6,390,703 issued on May 21, 2002 of Kinas et al. for a MEDIA HANDLING SYSTEM, U.S. Pat. No. 6,217,018 issued on Apr. 17, 2001 of Tay et al. for a SHEET FEEDING MECHANISM, and U.S. patent application Publication No. US 2002/0050680 A1 published on May 2, 2002 of Yanagi et al. for a SHEET FEEDING DEVICE AND RECORDING APPARATUS PROVIDED WITH THE SAME, all of which are specifically incorporated by reference for all that is contained therein.

With continued reference to FIG. 2, the printer 100 contains a conglomerate stack 150. The conglomerate stack 150 includes a first stack 160, a second stack 200 and a divider 240. The conglomerate stack 150 is located in the input tray 112. This conglomerate stack 150 contains two types of media; one type of media is contained in the first stack 150 and another type of media is contained in the second stack 160. The divider 240 separates the first stack 160 from the second stack 200.

Figure 3:
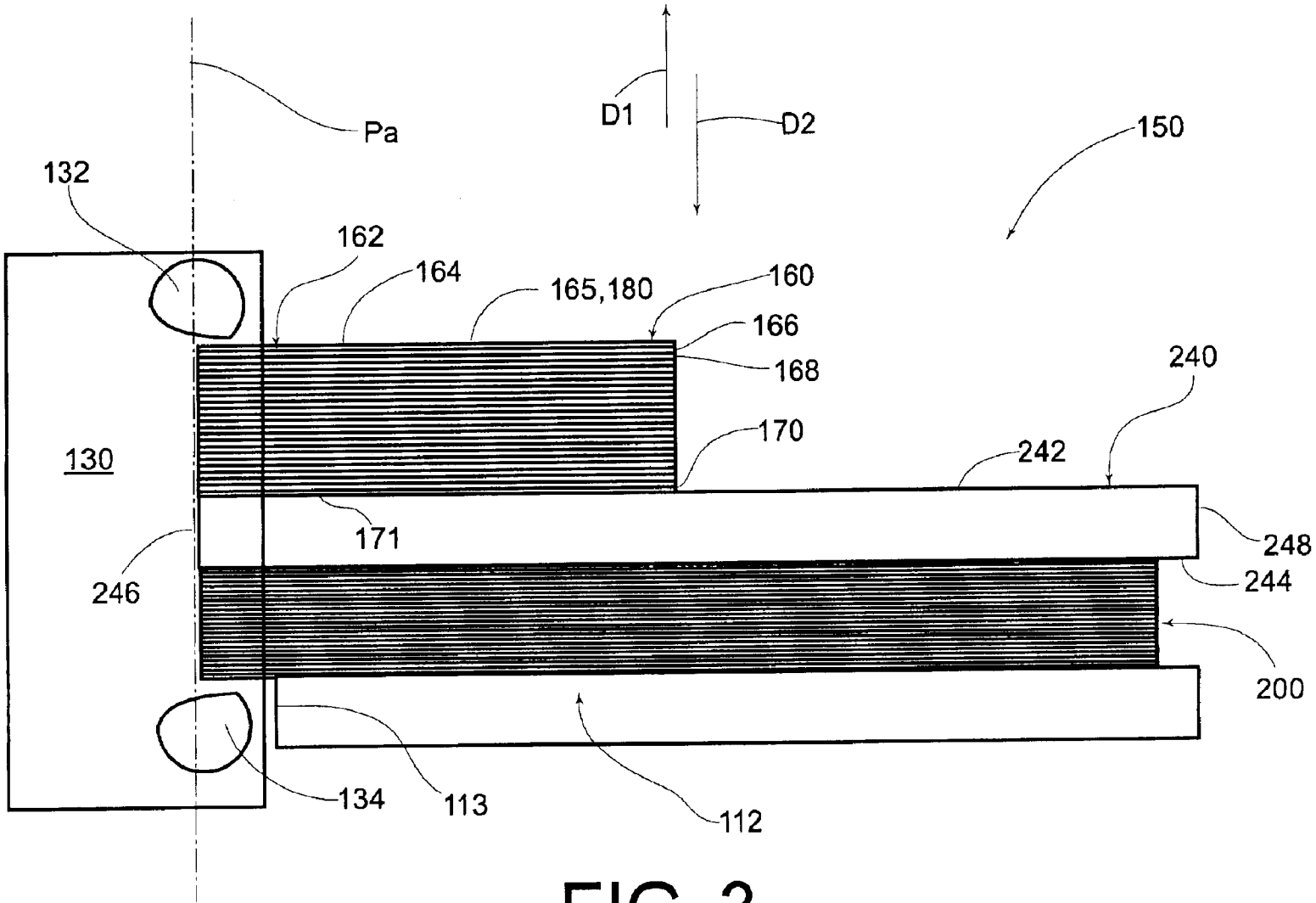
FIG. 3 shows a side elevation view of a conglomerate stack located on an input tray; a pick mechanism is also shown that is able to remove sheets of media from the conglomerate stack.
Figure 4:
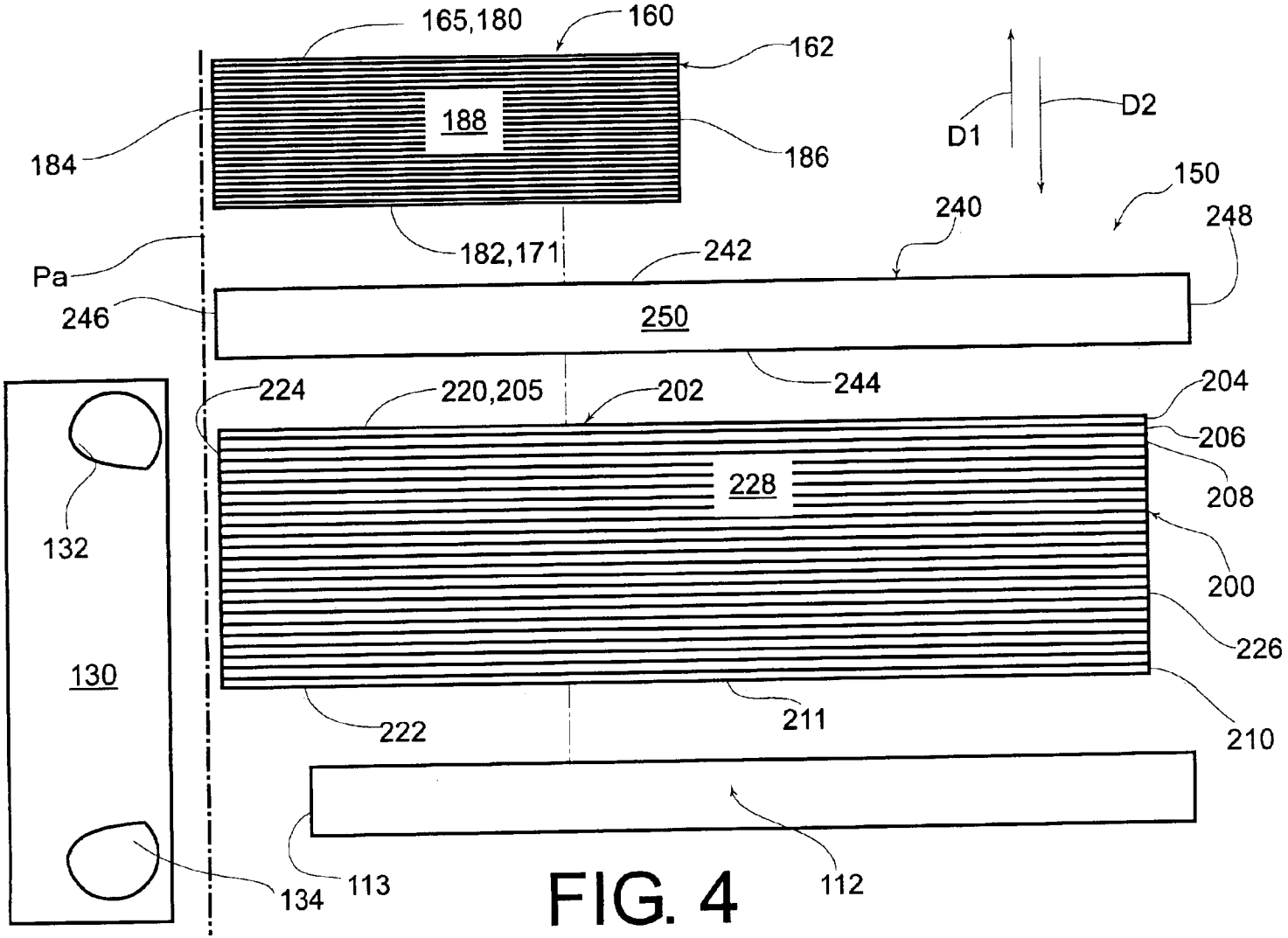
FIG. 4 shows an exploded side elevation view of the conglomerate stack of FIG. 3.

With reference to FIG. 3, the conglomerate stack first stack 160 contains a plurality of sheets 162 of media that are 'stacked' adjoining each other. As used herein, the term 'stacked' describes an orientation where several sheets are adjoining and relatively aligned with each other. The plurality of sheets 162 may, for example, include a first sheet 164, a second sheet 166, a third sheet 168 and a bottom sheet 170. The first stack first sheet 164 is provided with a first face 165. The first stack bottom sheet 170 is provided with a first face 171. A first direction D1 and an oppositely disposed second direction D2 illustrated in FIGS. 3 and 4 are useful for describing the orientation of the sheets 162. The first stack first sheet first face 165 may be facing in the first direction D1. The first stack bottom sheet first face 171 may be facing in the second direction D2. Additionally, the first stack second sheet 166 may be adjoining the first sheet 164; and, the third sheet 168 may be adjoining the second sheet 166.

FIG. 4 illustrates an exploded view of the conglomerate stack 150 (FIG. 3 shows a regular side elevation view of the same). With reference to FIG. 4, the plurality of sheets 162 may be collectively referred to herein as the first stack 160. The first stack 160 defines a top face 180, a bottom face 182, a front edge 184, a rear edge 186, a first side 188 and an oppositely disposed second side (not shown). The first stack top face 180 is the first sheet first face 165. The first stack bottom face 182 is oppositely disposed from the first stack top face 180 and is the bottom sheet first face 171. The printer 100 may define an alignment plane denoted by 'Pa'. The alignment plane Pa may be orientated in a substantially perpendicular manner relative to the input tray 112 and located between the pick mechanism 130 and the conglomerate stack 150. The first stack front edge 184 may be located in the alignment plane Pa. The first stack rear edge 186 is oppositely disposed from the front edge 184. The first side 188 may be perpendicular to both the front and rear edges 184, 186 and, therefore, perpendicular to the alignment plane Pa. The second side (not shown) may be parallel to and oppositely disposed from the first side 188.

With continued reference to FIG. 4, the conglomerate stack second stack 200 contains a plurality of sheets 202 of media that are stacked adjoining each other. The plurality of sheets 202 may include individual sheets such as a first sheet 204, a second sheet 206, a third sheet 208 and a bottom sheet 210. The second stack first sheet 204 is provided with a first face 205. The second stack bottom sheet 210 is provided with a first face 211. The second stack first sheet first face 205 may be facing in the first direction D1. The second stack bottom sheet first face 211 may be facing in the second direction D2. Additionally, the second stack second sheet 206 may be adjoining the first sheet 204 and the third sheet 208 may be adjoining the second sheet 206.

With continued reference to FIG. 4, the sheets 202 may be collectively referred to herein as the second stack 200. The second stack 200 defines a top face 220, a bottom face 222, a front edge 224, a rear edge 226, a first side 228 and an oppositely disposed second side (not shown). The second stack top face 220 is the first sheet first face 205. The bottom face 222 is oppositely disposed from the second stack top face 220 and is, therefore, the bottom sheet first face 211. The second stack front edge 224 may be located in the alignment plane Pa and, therefore, coplanar with the first stack front edge 184. The second stack rear edge 226 is oppositely disposed from the front edge 224. The first side 228 may be perpendicular to both the front and rear edges 224, 226 and, therefore, may be perpendicular to the alignment plane Pa. The second side (not shown) may be parallel to and oppositely disposed from the first side 228.

Figure 9:
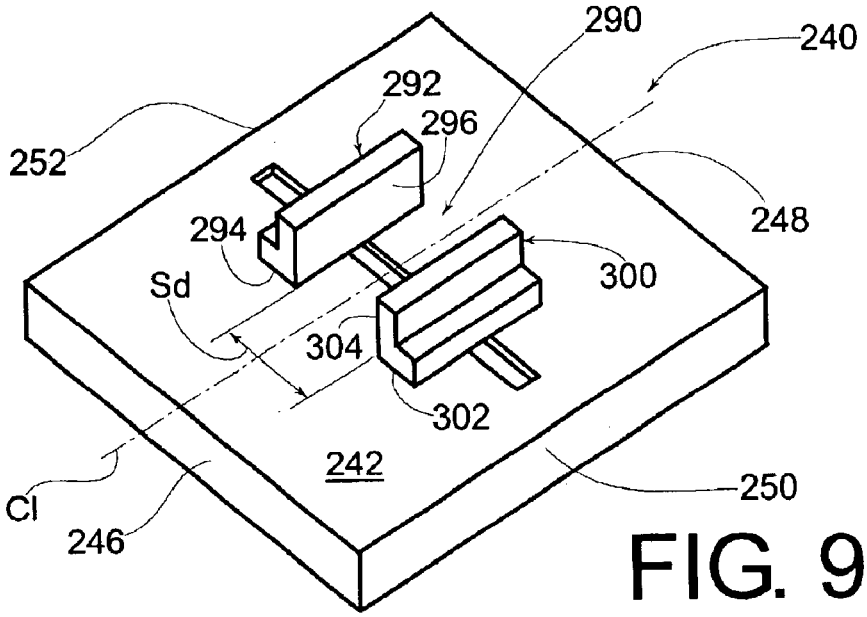
FIG. 9 shows a perspective view of a divider provided with guides.

FIG. 4 illustrates one embodiment wherein the conglomerate stack 150 is provided with the divider 240. The divider 240 separates the first stack 160 from the second stack 200. It should be noted that this divider 240 is removable from the input tray 112 and is, therefore, not physically attached to the printer 100 or the housing 110 (FIG. 2). The divider 240 is provided with a top face 242, a bottom face 244, a front edge 246, a rear edge 248, a first side 250 and an oppositely disposed second side 252 (FIG. 9). The divider top face 242 faces in the first direction D1. The bottom face 244 may be substantially parallel to and oppositely disposed relative to the divider top face 242. The front edge 246 may be located in the alignment plane Pa and, therefore, substantially coplanar with the first stack front edge 184 and the second stack front edge 224. The divider rear edge 248 is oppositely disposed from the front edge 246. The first side 250 is perpendicular to the front edge 246. The second side 252 (FIG. 9) may be parallel to and oppositely disposed relative to the first side 250. The pick mechanism 130 cannot pick the divider 240. One type of non-pickable divider 240 may be composed of a relatively rigid and/or thick material. In one exemplary embodiment, the divider 240 may be composed of high-density polyethylene that is about 0.0625 inches thick, it is to be understood that this thickness is provided for illustrative purposes only.

As illustrated in the exploded view of FIG. 4, the conglomerate stack 150 may be configured such that the first stack 160 is positioned on the divider 240. The first stack 160 may be positioned such that the first stack bottom face 182 is adjoining the divider top face 242. The divider 240 may be located on the second stack 200 such that the divider bottom face 244 is adjoining the second stack top face 220. Additionally, the stacks 160, 200 and the divider 240 may be configured such that their respective front edges 184, 246, 224 are located in the alignment plane Pa.

The conglomerate stack 150 is located in the input tray 112 for providing sheets of media to the printer 100. The second stack bottom face 222 is adjacent to the input tray 112, and the front edges 184, 246, 224 are adjacent to the pick mechanism 130.

General Overview of Use

Figure 5:
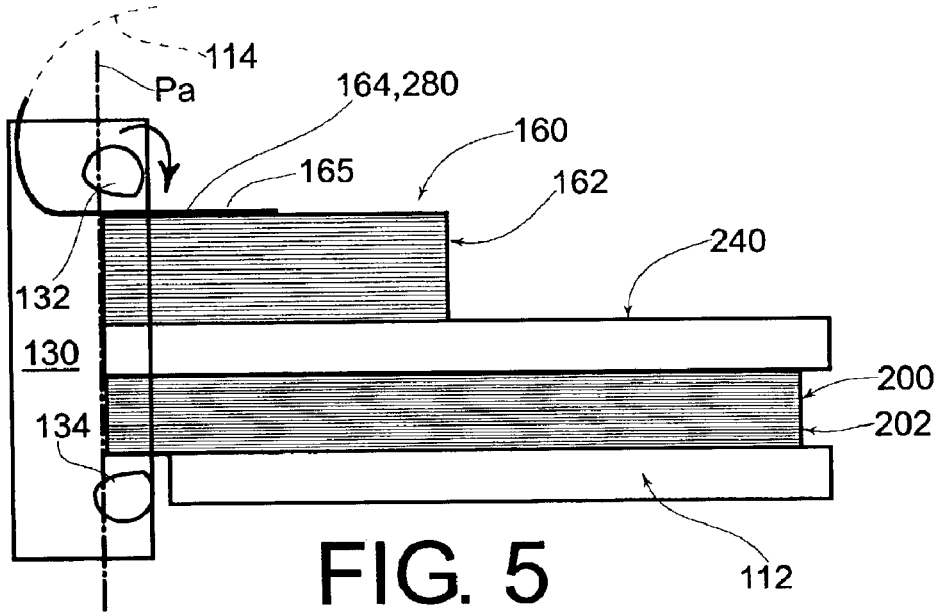
FIG. 5 shows a side elevation view of a sheet that is being picked from a first stack of media that is part of a conglomerate stack.
Figure 6:
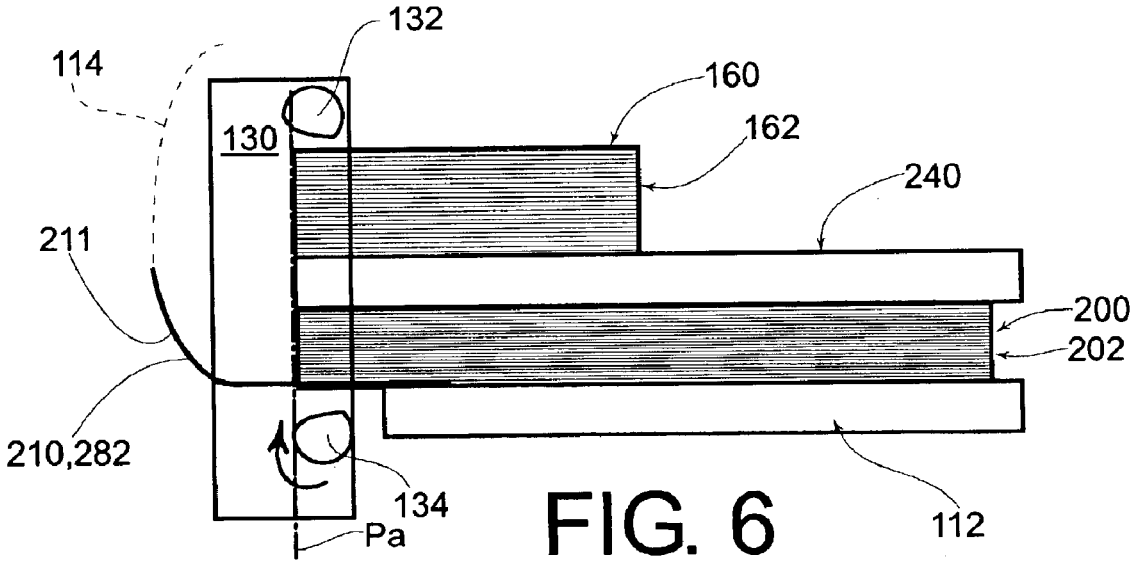
FIG. 6 shows a side elevation view of a sheet that is being picked from a second stack of media that is part of a conglomerate stack.

In general terms, the present media handling device and method allows for a two-page document to be printed on two types of media, such as a letter having a first page 280 (FIG. 5) that is preprinted with letterhead and a second page 282 (FIG. 6) that is plain-paper. This printing process occurs without the need to manually insert pages (other than an initial loading of sheets to the stacks) and requires only one input tray 112. With reference to FIG. 5, at the outset, the first page 280, e.g. preprinted letterhead, is picked from the first stack 160 by the first pick roller 132 and introduced to the path 114. An image is formed and fused on the first page 280 as it travels along the path 114. After printing the first page 280, the printer 100 prints the second page 282. With reference to FIG. 6, the second page 282, e.g. plain-paper, is picked by the second pick roller 134 from the second stack 200. After being picked, the second page 282 is introduced to the path 114. As the second page 282 travels along the path 114, an image is formed and fused thereon. After both pages 280, 282 of the document are printed, they are retrieved from the output area 118 (FIG. 2). This printing on selected media types can continue as long as each stack has sheets of media.

Detailed Description of Use

Having provided a general overview, the process of picking and printing a sheet from the first stack 160 will now be described in further detail. As illustrated in FIG. 5, the pick mechanism first roller 132 is able to 'pick' individual sheets 162 from the first stack 160. As used herein, the term 'pick' refers to the process of removing one sheet from a stack, such as removing the first sheet 164 from stack 160. The first sheet 164 may be picked by rotating the first roller 132, which is in contact with the first sheet first face 165. This rotation may cause the first sheet 164 to slide from the first stack 160 and pass through the alignment plane Pa. After beginning to pass through the alignment plane Pa, the first sheet 164 may enter into the area of the pick mechanism 130. Once the first sheet 164 is in the pick mechanism 130, it travels along the path 114. With reference to FIG. 2, the first sheet 164 travels along the path 114 past the imaging device 116 where an image of an imaging agent (e.g. toner) is formed on the first sheet 164. After the image is formed, the first sheet 164 passes through the fuser 117 where the image is permanently fused to the first sheet 164. After the image is fused on the first sheet 164, the first sheet 164 exits the printer housing 110 and is placed into the output area 118.

Figure 11:
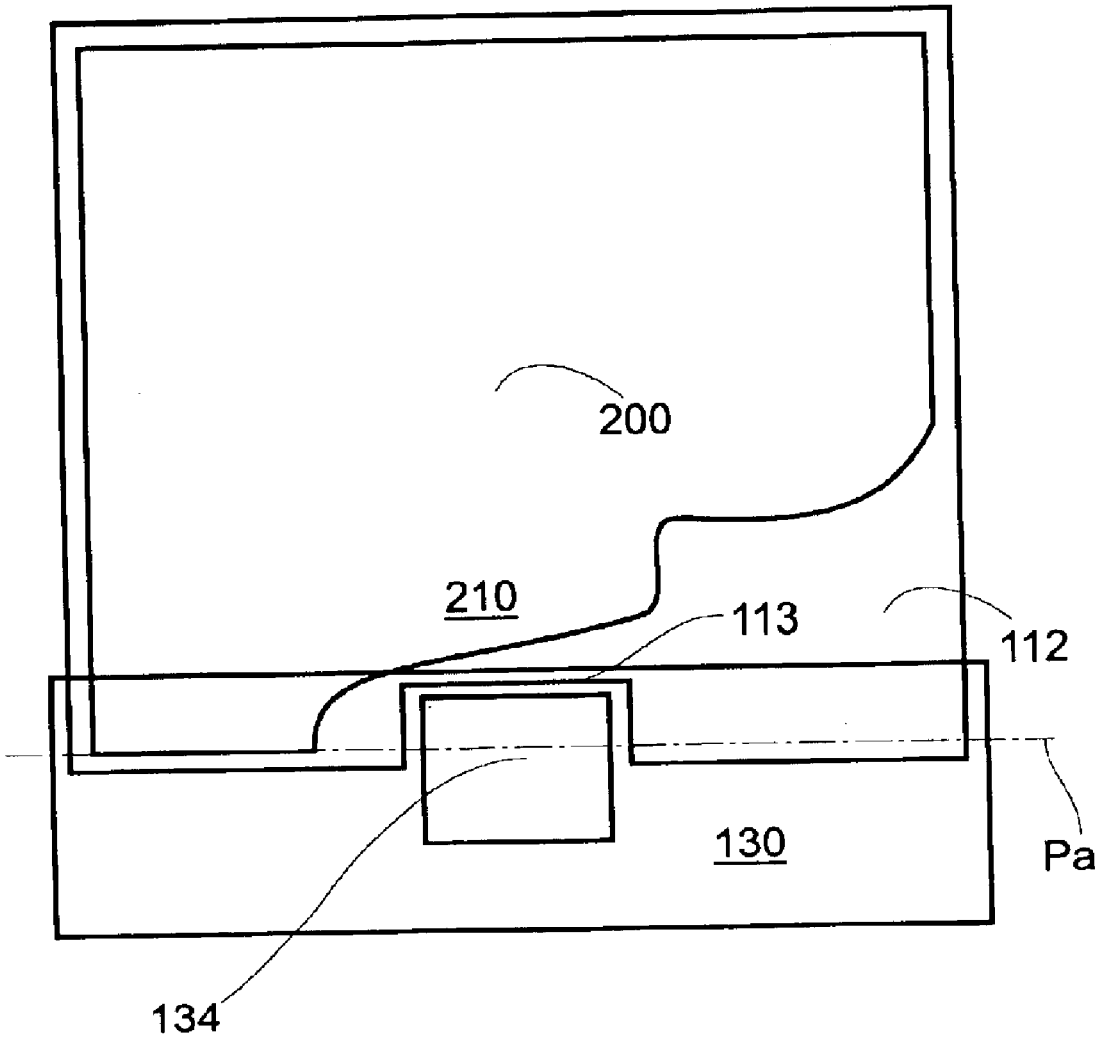
FIG. 11 shows a top plan view of a lift plate, a window and a pick mechanism roller.

The printer 100 also picks sheets of media from the second stack 200 by a process that will now be described. As illustrated in FIG. 6, the pick mechanism second roller 134 is able to pick individual sheets from the second stack 200. As illustrated, the second stack bottom sheet 210 may be picked by rotating the second roller 134, which is in contact with the bottom sheet first face 211. It should be noted that the lift plate 112 may be provided with a window 113 as illustrated in FIG. 11. This lift plate window 113 may allow the pick mechanism second roller 134 to contact the second stack bottom sheet 210. With reference to FIG. 6, this rotation of the pick mechanism second roller 134 in the lift plate window 113 causes the bottom sheet 210 to slide from the second stack 200 and pass through the alignment plane Pa. After beginning to pass through the alignment plane Pa, the bottom sheet 210 may enter into the area of the pick mechanism 130. Once the bottom sheet 210 is in the pick mechanism 130, it travels along the path 114. With reference to FIG. 2, the second stack bottom sheet 210 travels along the path 114 past the imaging device 116 where an image of an imaging agent (e.g. toner) is formed on the bottom sheet 210. After the image is formed, the bottom sheet 210 passes through the fuser 117 where the image is permanently fused to the bottom sheet 210. After the image is fused on the bottom sheet 210, the bottom sheet 210 exits the printer housing 110 and is placed into the output area 118.

As illustrated in FIGS. 5 and 6, sheets of media processed in the printer 100 are selectively picked from either stack 160, 200 depending on what type of media is desired. This picking may continue until the stack that contains the desired media is empty (once empty, the stack can be replenished by inserting sheets of media).

Figure 7:
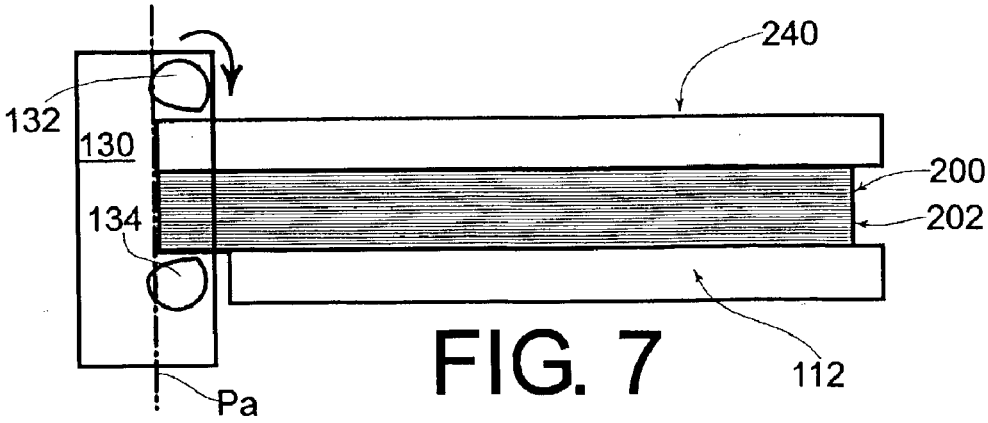
FIG. 7 shows a side elevation view of a conglomerate stack in which a first stack has been depleted.
Figure 8:
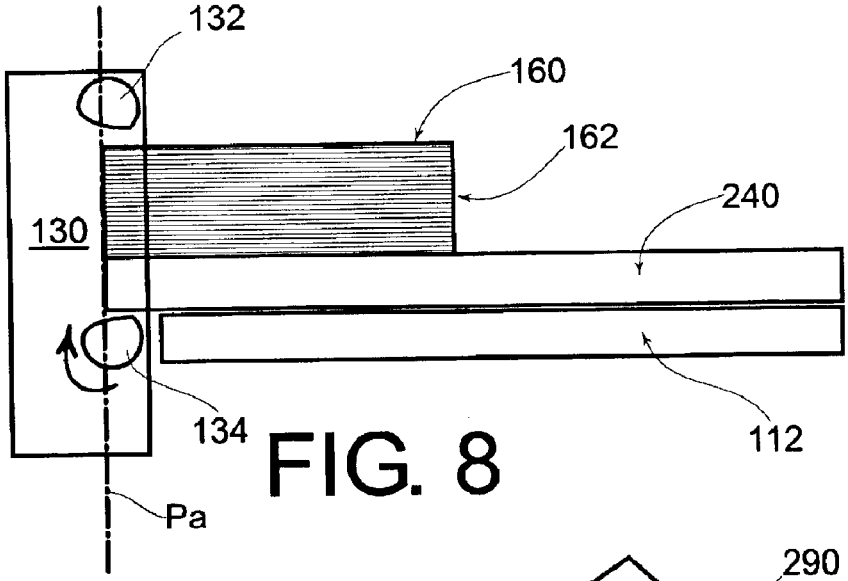
FIG. 8 shows a side elevation view of a conglomerate stack in which a second stack has been depleted.

FIGS. 7 and 8 illustrate conditions in which the stacks 160, 200, respectively, are empty. If the stack containing desired media is empty, the stack needs to be 'filled' before printing occurs. FIG. 7 illustrates a case when the first stack 160 does not exist because it does not contain any sheets of media. If the printer 100 attempts to pick a sheet from the first stack 160 when it is empty, the pick mechanism first roller 132 contacts the non-pickable divider 240. Since the divider 240 cannot be picked by the pick mechanism 130, the path 114 does not receive a sheet for the printing process. Without a sheet to print on, the printing process cannot proceed. If printing cannot proceed, the printer 100 suspends the printing process. In another example illustrated in FIG. 8, if the printer 100 attempts to pick a sheet from the second stack 200 when it is empty, the pick mechanism second roller 134 contacts the non-pickable divider 240. Since the divider 240 cannot be picked by the pick mechanism 130, it remains in the input tray 112. Additionally, since media is not available for the printing process, the printer 100 suspends the printing process. Once the second stack 200 is replenished, the printing process can resume.

The previously described media handling device allows for two types of media to be processed. This media handling device requires only one input tray and has limited additional mechanical complexity. Since only one input tray is required, the present media handling device is robust, compact and economical.

ALTERNATIVE EMBODIMENTS

Although the media handling device 10 (FIG. 1) and the printer 100 (FIG. 2) have been described in detail, it is to be understood that the concepts disclosed herein can be embodied into a variety of other types of devices that are used for processing documents such as binding equipment, sorting equipment, duplexing equipment, imaging apparatus and the like.

It is to be understood that terms such as 'front', 'back', 'top', 'bottom', 'horizontal', 'vertical', 'rear', 'side' and the like are used herein for illustrative purposes only. In actual use, the media handling device 10 and printer 100 can be configured in almost any orientation, thus making terms such as 'front', 'back', 'top', 'bottom', 'horizontal', 'vertical', 'rear', 'side', etc. relative to the orientation of the object which they describe.

In one alternative embodiment illustrated in FIG. 9, the conglomerate stack divider 240 may be provided with a guide system 290. The guide system 290 may be provided for guiding sheets of media that are located on the divider 200 (such as the first stack 160, FIG. 8). The guide system 290 may include a first guide 292 and a second guide 300. The first guide 292 may be provided with a first face 294 and a second face 296. The first guide first face 294 may be configured to slide along the divider top face 242. The second face 296 may be formed perpendicular to the first face 294 and, therefore, extend from the divider top face 242. The second guide 300 may be provided with a first face 302 and a second face 304. The second guide first face 302 may be configured to slide along the divider top face 242. The second face 304 may be formed perpendicular to the first face 302 and, therefore, extend from the divider top face 242. The first guide second face 296 is separated from the second guide second face 304 by a separation distance denoted by 'Sd'. In one exemplary embodiment, the first divider second face 296 and the second divider second face 304 may be symmetrically displaceable from a center line denoted by 'Cl' in FIG. 9. This symmetrical displacement may be provided by forming a conventional rack-and-gear assembly on the guides 292, 300 and the divider 240. The separation distance Sd may be altered to accommodate for varying widths of sheets. In use, the guide system 290 serves to center the first stack 160 (FIG. 8) with respect to the printer 100.

In another alternative embodiment illustrated in FIG. 9, the conglomerate stack divider 240 may be configured so the width thereof can be varied. This width variation may result in the first side 250 and the second side 252 moving away from or moving closer to the center line Cl. By allowing for variation of the conglomerate stack diver 240 width, the conglomerate stack divider 240 may be modified such that its width matches width of the stack (e.g. second stack 354, FIG. 10 or second stack 200, FIG. 5).

Figure 10:
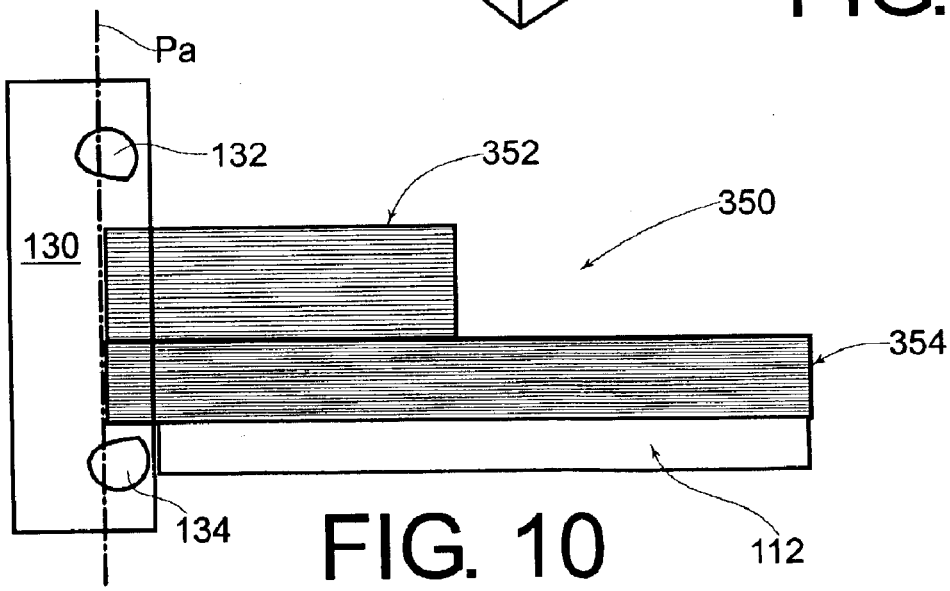
FIG. 10 shows a side elevation view of a conglomerate stack provided with a first stack and an adjoining second stack.

In another alternative embodiment illustrated in FIG. 10, a divider-less conglomerate stack 350 may be provided with just a first stack 352 and a second stack 354. Therefore, the first stack 352 is located adjoining the second stack 354. When configured without the divider 240 (FIG. 4), the pick mechanism 130 picks media from the divider-less conglomerate stack 350 without monitoring if one of the two stacks 352, 354 is empty. In this embodiment, the media handling device may, inadvertently, process one type of media when it intends to process a second type of media. This may occur because the non-pickable divider 240 (FIG. 8) has been omitted. This omission may allow the first pick roller 132 to pick from the second stack 354. This omission also allows the second pick roller 134 to pick from the first stack 352. Although this inadvertent printing on different types of media may occur, the omission of the divider 240 (FIG. 8) may be useful in some applications.

In order to avoid printing on improper media, media sensing technologies, well known to those skilled in the art, may be utilized. This utilization may aid in preventing the inadvertent printing on unintended media. These sensing technologies may be classified as proactive or reactive. Proactive technologies sense the media before printing, while the media is still located within the input bin (prior to printing). This may be done using optical, magnetic, electrical techniques, and so forth. Reactive techniques, on the other hand, sense the media being printed during or after it has been printed. In the case of an electro-photographic printer (as depicted in FIG. 2), a particularly low-cost technique is to infer the media's type by measuring its resistivity as it passes along the media path 114. In this case, the printer would infer that one input bin is empty once it has printed and sensed that it has in fact printed on a different media type. The printer would then stop printing, then instruct the user to replenish the empty input bin, and then finally instruct the user to discard/recycle the sheet printed on the different media.

In another alternative embodiment, the pick mechanism pick rollers may rotate in a direction opposite of each other. For example, with reference to FIG. 5, the second pick roller 134 may be rotated in a direction that is opposite than the first pick roller 132. This counter-rotation may serve to keep the second stack sheets 202 from advancing into the pick mechanism 130. For example, in one exemplary embodiment, the pick mechanism 130 depicted in FIG. 2 may pick media by contacting the first pick roller 132 to the first stack 160, thereby causing individual sheets of media to be picked. Due to inter-sheet friction, multiple sheets may be easily picked (although the intent is to pick only one sheet). To avoid multi-feeds, a separation-pad may be used. This pad, located below but in contact with the first pick roller 134, acts to increase the friction on any additional sheets that may be inadvertently picked along with the first sheet. As such, the friction by the first pick roller 134 may cause the first page to be picked. If the inter-sheet friction is great enough, the separation pad increases the friction on these additional sheets to a degree greater than the inter-sheet friction. The bottom sheets essentially stop, and only one sheet continues in the paper path. With the present alternative embodiment, the pick mechanism 130 may incorporate a counter-rotation methodology. One roller (e.g. the first pick roller 132) may act as the pick roller, while the other roller (e.g. the second pick roller 134) may act as a counter-rotation 'retard' roller. The retard roller "acts" as the separation pad in the previously described apparatus. When picking from the top of the conglomerate stack 150, the second pick roller 134 acts as a retard roller.

While illustrative embodiments have been described in detail herein, it is to be understood that the inventive concepts may be otherwise variously embodied as previously mention. The appended claims are intended to be construed to include such variations except insofar as limited by the prior art.

I claim:

1. A media handling device comprising:

a conglomerate stack comprising a first stack of a first type of media and an adjacent second stack of a second type of media;

a pick mechanism configured to selectively pick sheets from said first stack and said second stack;

wherein said pick mechanism comprises a first pick roller contacting said first stack and a second pick roller contacting said second stack;

wherein said first stack comprises a first edge; and wherein said second stack comprises a first edge that lies in a common vertical plane with said first stack first edge.

2. The media handling device of claim 1 and further comprising:

a path formed inside said media handling device; and wherein, said pick mechanism is configured to transfer said sheets from either said first stack or said stack to said path.

3. The device of claim 2 and further comprising:

an imaging assembly formed in said media handling device and adjacent to said path.

4. The device of claim 3 wherein said imaging assembly comprises an imaging agent.

5. The device of claim 1 wherein:

said pick mechanism is contacting said first stack near said first stack first edge, and said pick mechanism is contacting said second stack near said second stack first edge.

6. The device of claim 1 and further comprising:

a divider separating said first stack from said second stack.

7. The device of claim 1 and further comprising:

a first face located on said first stack, said first stack first face facing a first direction;

a second face located on said second stack, said second stack second face facing a second direction that is oppositely disposed from said first direction;

a first condition and a second condition of said media handling device;

wherein, in said first condition said first roller contacts said first stack first face; and wherein, in said second condition said second roller contacts said second stack first face.

8. A media handling device comprising:

a conglomerate stack comprising a first stack of a first type of media and an adjacent second stack of a second type of media;

a pick mechanism configured to selectively pick sheets from said first stack and said second stack;

wherein said pick mechanism comprises a first pick roller contacting said first stack and a second pick roller contacting said second stack;

wherein said first stack comprises a first edge; and wherein said second stack comprises a first edge that is coplanar with said first stack first edge;

a guide assembly formed on said divider.

9. The device of claim 8 wherein said guide assembly is symmetrically displaceable on said divider.

10. A method of handling media comprising:

providing a first stack of a first type of media adjacent to a second stack of a second type of media;

providing a divider disposed between said first stack and said second stack;

providing a pick mechanism in said media handling device;

picking a first sheet from said first stack with said pick mechanism;

picking a second sheet from said second stack with said pick mechanism;

providing said pick mechanism comprising a first pick roller and a second pick roller;

wherein said picking comprises rotating at least one of said rollers; and wherein said first stack comprises a first edge and said second satck defines a second edge that lies in a common vertical plane with said first stack first edge.

11. The method of claim 10 wherein said rotating at least one of said rollers comprises rotating said first pick roller to pick said first sheet, while said second roller is stationary.

12. The method of claim 10 wherein said rotating at least one of said rollers comprises rotating said first pick roller in a first direction to pick said first sheet, and rotating said second roller in a second direction opposite of said first direction.

13. A media handling device comprising:

a conglomerate stack comprising a first stack of a first type of media and an adjacent second stack of a second type of media;

a pick mechanism comprising a first picker and a second picker, said first picker contacting said first stack and said second picker contacting said second stack; and wherein at least a portion of said first stack overlies at least a portion of said second stack.

14. The media handling device of claim 13 and further comprising:

a path formed inside said media handling device; and wherein, said pick mechanism first and second pickers contact said path.

15. The device of claim 14 and further comprising:

an imaging assembly formed in said media handling device and adjacent to said path.

16. The device of claim 13 wherein:

said first stack comprises a first edge;

said second stack comprises a first edge that is coplanar with said first stack first edge;

said pick mechanism first picker is contacting said first stack near said first stack first edge, and said pick mechanism second picker is contacting said second stack near said second stack first edge.

17. The device of claim 13 and further comprising:

a divider separating said first stack from said second stack.

18. The device of claim 17 and further comprising:

a guide assembly formed on said divider.

19. The device of claim 13 and further comprising:

a first face located on said first stack, said first stack first face facing a first direction;

a second face located on said second stack, said second stack second face facing a second direction that is oppositely disposed from said first direction;

a first condition and a second condition of said media handling device;

wherein, in said first condition said first picker contacts said first stack first face; and wherein, in said second condition said second picker contacts said second stack first face.

20. A media handling device comprising:

an input tray;

a conglomerate stack of media located at least partially within said input tray, said conglomerate stack of media comprising a first type of media and a second type of media adjacent said first type of media;

a pick mechanism comprising a first pick roller and a second pick roller;

wherein said first pick roller is in contact with said first type of media and said second pick roller is in contact with said second type of media; and wherein at least a portion of said first type of media overlies at least a portion of said second type of media.

21. The media handling device of claim 20 and further comprising a divider separating said first type of media from said second type of media.

* * * * *

UNITED STATES PATENT AND TRADEMARK OFFICE

CERTIFICATE OF CORRECTION

PATENT NO. : 7,063,314 B2
APPLICATION NO. : 10/298752
DATED : June 20, 2006
INVENTOR(S) : Eric U. Eskey It is certified that error appears in the above-identified patent and that said Letters Patent is hereby corrected as shown below:

In column 9, line 63, in Claim 10, delete “satck” and insert -- stack --, therefor.

Signed and Sealed this

Third Day of March, 2009

JOHN DOLL
*Acting Director of the United States Patent and Trademark Office*